US006527681B2

(12) United States Patent
Tacx

(10) Patent No.: US 6,527,681 B2
(45) Date of Patent: Mar. 4, 2003

(54) HOME TRAINER

(75) Inventor: Jacobus Hubertus Tacx, Wassenaar (NL)

(73) Assignee: Technische Industrie Tacx B.V., Wassenaar (NL)

( * ) Notice: Subject to any disclaimer, the term of this patent is extended or adjusted under 35 U.S.C. 154(b) by 32 days.

(21) Appl. No.: 09/803,200

(22) Filed: Mar. 9, 2001

(65) Prior Publication Data

US 2002/0013197 A1 Jan. 31, 2002

(30) Foreign Application Priority Data

Mar. 10, 2000 (NL) ..... 1014610

(51) Int. Cl.[7] ..... A63B 23/04
(52) U.S. Cl. ..... 482/61; 482/57
(58) Field of Search ..... 482/51, 57, 60–65

(56) References Cited

U.S. PATENT DOCUMENTS 5,611,759 A * 3/1997 Zeh et al. ..... 482/61

5,728,029 A * 3/1998 Minoura ..... 482/61

* cited by examiner

*Primary Examiner*—Glenn E. Richman
(74) *Attorney, Agent, or Firm*—Jeffrey D. Myers

(57) ABSTRACT

The invention relates to a home trainer designed to accommodate a bicycle, comprising a brakable drive roll incorporated in a frame, which can be mounted in a friction coupling with a driven wheel of the bicycle. The frame is provided with a sub-frame that is rotatable about a first pivoting point, the drive roll being mounted in the sub-frame. The frame is further provided with a handle rotatable about a second pivoting point, which is adjustable between an operational position wherein the handle pushes the sub-frame towards the wheel such that the drive roll and the wheel maintain the friction coupling, and a neutral position wherein the handle releases the sub-frame such that the drive roll and the wheel do not engage.

7 Claims, 2 Drawing Sheets

HOME TRAINER

Figure 1:
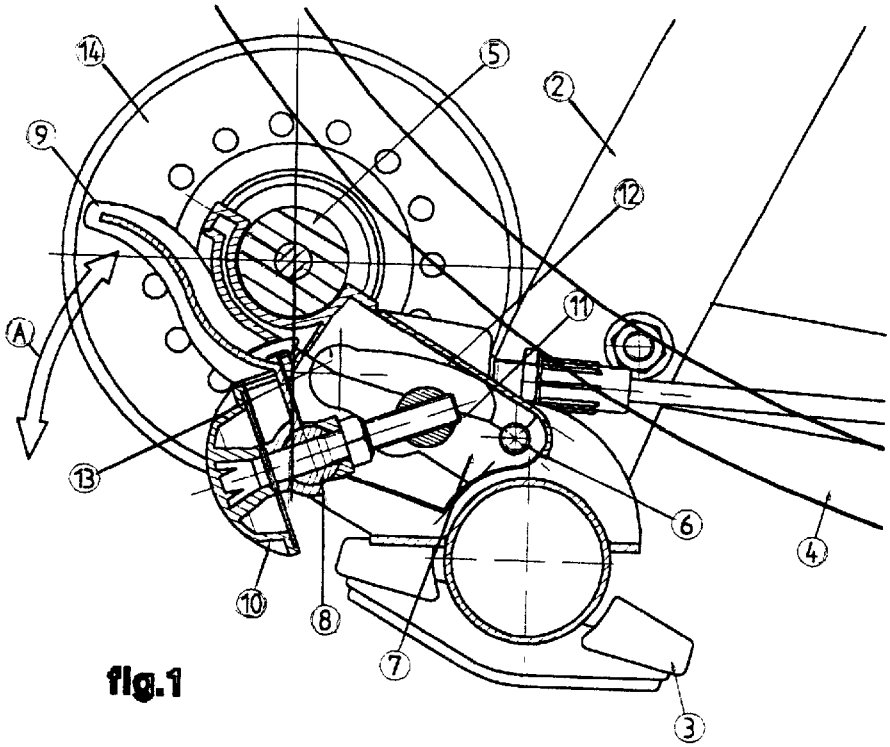

The invention relates to a home trainer designed to accommodate a bicycle, comprising a brakable drive roll incorporated in a frame, which can be mounted in a friction coupling with a driven wheel of the bicycle.

Such a home trainer is known in practice. One problem with the known home trainer occurs when changing the bicycle mounted in the home trainer; positioning the drive roll such as to realize the desired friction coupling with the driven wheel of the bicycle involves some rather complicated operations. Another problem is that the required cycling energy to be produced by the user when using the home trainer is usually adjusted by means of a brake which is susceptible to wear.

It is the object of the invention to eliminate the problems of the prior art home trainer and to attain advantages that will be explained hereinbelow.

In a first aspect, the home trainer according to the invention is characterized in that on the frame a sub-frame is provided that is rotatable about a first pivoting point, the drive roll being mounted in the sub-frame, and in that the frame is further provided with a handle rotatable about a second pivoting point, which is adjustable between an operational position wherein the handle pushes the sub-frame towards the wheel such that the drive roll and the wheel maintain the friction coupling, and a neutral position wherein the handle releases the sub-frame such that the drive roll and the wheel do not engage. Among other things, this measure provides a very simple manner of changing a bicycle, while reliably and easily realizing a suitable friction coupling between drive roll and bicycle wheel, even if the newly mounted bicycle has different wheel sizes.

This is promoted particularly in the embodiment that is preferred, and which is characterized in that the handle is provided with an adjustable tuning knob for determining the position of the sub-frame in the operational position.

A mechanically reliable, low-cost manufactured embodiment of the home trainer according to the invention is characterized in that at the side directed towards the sub-frame, the tuning knob is provided with a bush, and in that the sub-frame has a sliding rim designed to intermate with the bush, the sliding rim terminating in a recess which, when the bush is placed therein, determines the operational position of the handle.

In a further aspect of the invention the home trainer is characterized in that the drive roll is coupled with a flywheel that conducts at least partially magnetic lines of flux, and in that further a position-adjustable magnet is provided which is located near the flywheel. In this manner a wear-resistant brake is provided, allowing the continuous adjustment of the home trainer to a desirable load such as requisite for the rotation of the drive roll.

This is preferably achieved by the magnet being adjustable to a position between a neutral position near a pivoting point of the flywheel and a maximal brake position near the outer circumference of the flywheel. Desirably, the flywheel is provided with recesses, preferably over a periphery located near the neutral position of the magnet. In this manner a very effective cooling of the flywheel is obtained.

It is further preferred that the flywheel comprise an aluminium disc and moreover, that the flywheel be substantially made of steel.

The control of the home trainer according to the invention may be embodied simply such that the magnet is coupled with a spring-loaded cable and that the magnet is adjustable by operating the cable.

Figure 2:
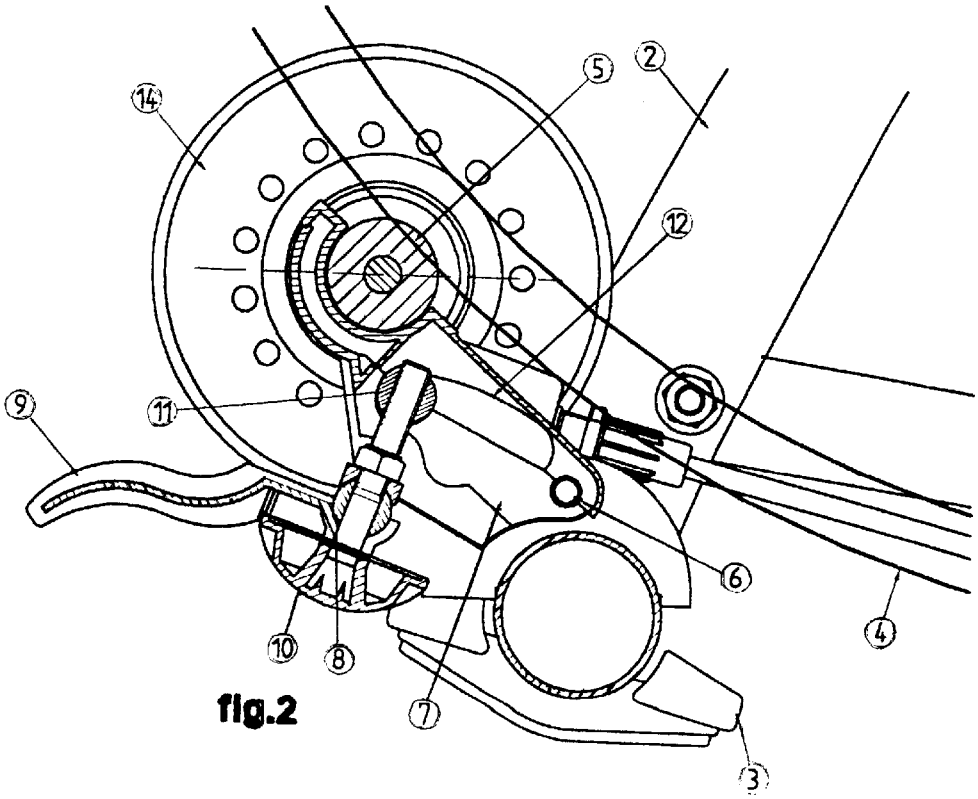
Figure 3:
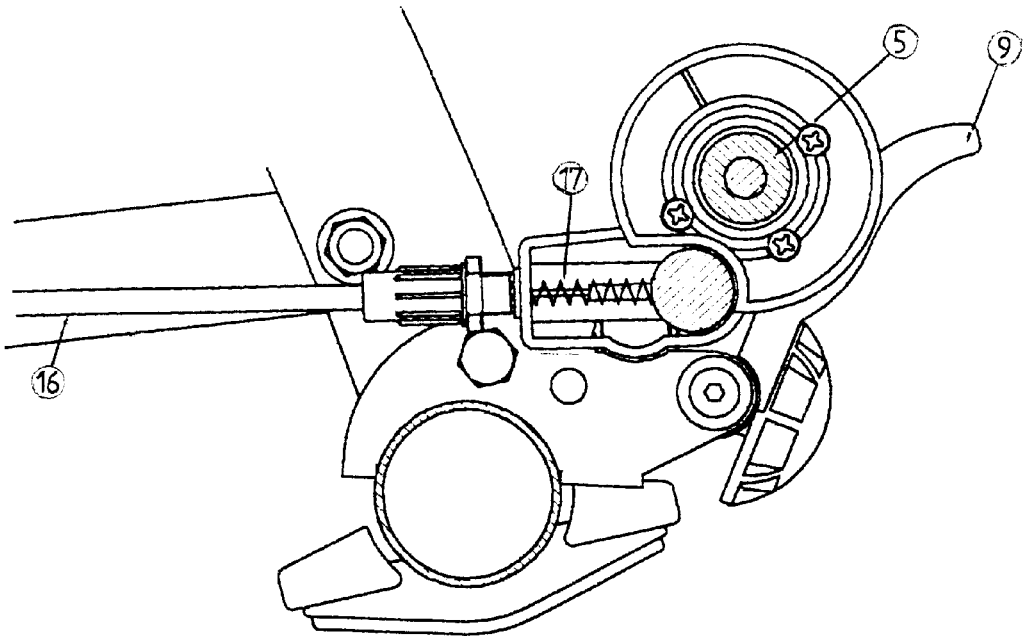
Figure 4:
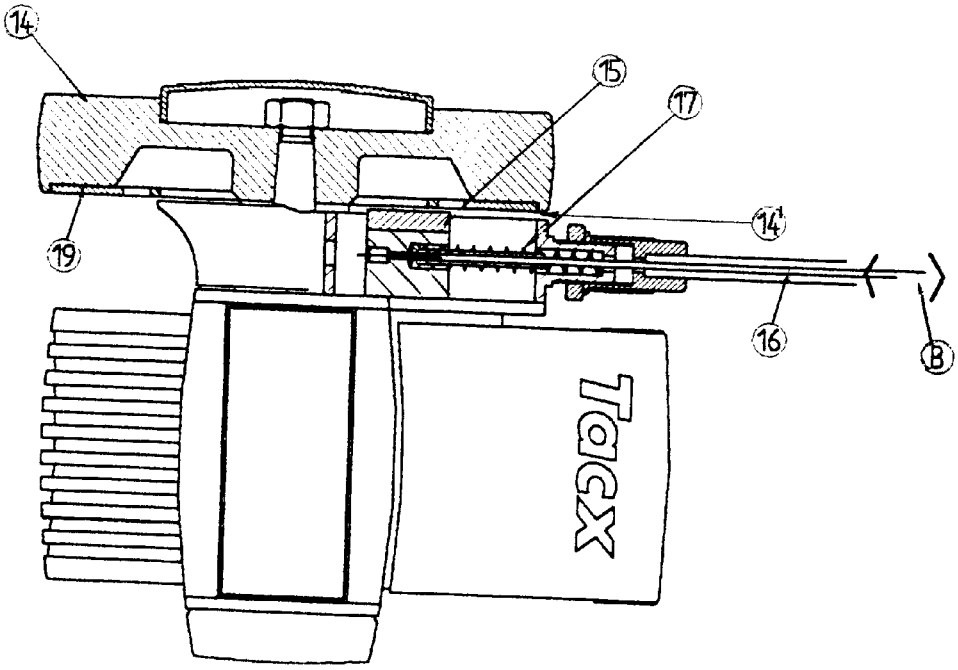

The invention will now be elucidated with reference to the drawing, which in FIGS. 1 and 2 shows a detailed side view of the home trainer according to the invention in neutral and operational position, respectively;

in FIG. 3, shows a cross-sectional detail of the home trainer according to the invention relating to the brake facility; and in FIG. 4, shows a cross-sectional top view (mirror image) of the brake feature of the home trainer according to the invention.

Identical reference numbers used in the figures refer to similar components.

The person skilled in the art and the public, are completely familiar with the embodiment of the home trainer as such, so that no further elucidation is called for. The home trainer according to the prior art and according to the invention comprising among other things, a frame 1, which includes a supporting leg 2. At the end of the supporting leg 2 a foot 3 is provided which rests on a floor. A home trainer of this kind is embodied such as to be able to accommodate a bicycle. Of this bicycle, FIGS. 1 and 2 show the tyre 4, which is usually fitted around the driven rear wheel of the bicycle. The home trainer is further provided with a drive roll 5 to be placed in a friction coupling with the rear wheel 4 of the bicycle. FIG. 1 shows the neutral position, while FIG. 2 shows the operational position. In order to be able to change between the positions shown in FIG. 1, and FIG. 2, the frame 1 is equipped with a sub-frame 7 rotatable about a first pivoting point 6, with the drive roll 5 being mounted in the sub-frame 7. The frame 1 is further provided with a handle 9 which is rotatable about a second pivoting point 8, which handle is adjustable by moving it in the direction indicated by arrow A in FIG. 1, between the neutral position shown in FIG. 1 in which the handle 9 releases the sub-frame 7 such that the drive roll 5 and the wheel 4 do not engage, and the operational position shown in FIG. 2, in which the handle 9 pushes the sub-frame 7 towards the wheel 4 such that the drive roll 5 and the wheel 4 maintain the friction coupling. FIGS. 1 and 2 further show that the handle 9 is provided with an adjustable tuning knob 10 for determining the position of the sub-frame 7 in the operational position. This facilitates an adjustment to the thickness or the diameter the rear wheel 4. At the side directed towards the sub-frame 7, the tuning knob 10 is further provided with a bush 11, and the sub-frame 7 has a sliding rim 12 which intermates with the bush 11 and which sliding rim 12 terminates in a recess 13, clearly shown in FIG. 1, which recess 13, when the bush 11 is placed therein, determines the operational position of the handle 9.

With further reference to the FIGS. 3 and 4 it is remarked, that the drive roll 5 is coupled with a flywheel 14 conducting at least partially magnetic lines of flux, while further a position-adjustable magnet 15 is provided which is located near the flywheel 14. The magnet 15 is adjustable to a position between a neutral position near a pivoting point of the flywheel 14 and a maximal brake position near the outer circumference 14' of the flywheel 14. To this end the magnet is coupled with a spring-loaded cable 16 which is adjustable by moving the same in the direction of arrow B, shown in FIG. 4. By tensioning the cable 16, a spring 17 loading the cable 16 is retracted and the magnet 15 moves in the direction of the outer circumference 14' of the flywheel 14. In this position the flywheel 14 experiences a maximum braking deceleration. When easing the cable 16, the magnet 15 moves under the influence of the spring 17 in the direction of the neutral position near the pivoting point of the flywheel 14. Over a periphery located near the neutral position of the magnet 15, the flywheel 14 is preferably provided with recesses 18, which are clearly visible in FIGS. 1 and 2. These provide an effective cooling of the flywheel 14. It is further remarked, that the flywheel 14 is embodied with an aluminium disk 19, and that the remainder of the flywheel 14 is substantially made of steel.

What is claimed is:

1. A home trainer designed to accommodate a bicycle, the home trainer comprising:

a frame;

a brakable drive roll incorporated into the frame, which drive roll is mountable in a friction coupling with a driven wheel of the bicycle;

a sub-frame provided on the frame that is rotatable about a first pivoting point, the drive roll being mounted in the sub-frame;

a handle provided on the frame and rotatable about a second pivoting point, which handle is adjustable between an operational position in which the handle pushes the sub-frame towards the wheel such that the drive roll and the wheel maintain the friction coupling, and a neutral position in which the handle releases the sub-frame such that the drive roll and the wheel do not engage; and an adjustable tuning knob proximate the handle for determining the position of the sub-frame in the operational position.

2. A home trainer according to claim 1 wherein at a side directed towards the sub-frame, the tuning knob is provided with a bush, and the sub-frame has a sliding rim designed to intermate with the bush, the sliding rim terminating in a recess which, when the bush is placed therein, determines the operational position of the handle.

3. A home trainer according to claim 1 wherein the drive roll is coupled with a flywheel that conducts at least partially magnetic lines of flux, and additionally comprising a position-adjustable magnet located near the flywheel.

4. A home trainer according to claim 3 wherein the magnet is adjustable to a position between a neutral position near a pivoting point of the flywheel and a maximal brake position near an outer circumference of the flywheel.

5. A home trainer according to claim 3 wherein the flywheel comprises recesses over a periphery located near the neutral position of the magnet.

6. A home trainer according to claim 3 wherein the flywheel comprises an aluminum disc and wherein a remainder of the flywheel is substantially made of steel.

7. A home trainer according to claim 3 wherein the magnet is coupled with a spring-loaded cable and the magnet is adjustable by operating a cable.

* * * * *

US006527681C1

(12) EX PARTE REEXAMINATION CERTIFICATE (8662nd)

United States Patent

Tacx

(10) Number: US 6,527,681 C1

(45) Certificate Issued: Nov. 15, 2011

(54) HOME TRAINER

(75) Inventor: Jacobus Hubertus Tacx, Wassenaar (NL)

(73) Assignee: Technische Industrie Tacx B.V., Wassenaar (NL)

Reexamination Request:
No. 90/011,686, May 11, 2011

Reexamination Certificate for:

| | |
|---|---|
| Patent No.: | **6,527,681** |
| Issued: | **Mar. 4, 2003** |
| Appl. No.: | **09/803,200** |
| Filed: | **Mar. 9, 2001** |

(30) Foreign Application Priority Data

Mar. 10, 2000 (NL) ..... 1014610

(51) Int. Cl.
*A63B 26/04* (2006.01)

(52) U.S. Cl. ..... 482/61; 482/57

(58) Field of Classification Search ..... 482/61, 482/57

See application file for complete search history.

(56) References Cited

To view the complete listing of prior art documents cited during the proceeding for Reexamination Control Number 90/011,686, please refer to the USPTO's public Patent Application Information Retrieval (PAIR) system under the Display References tab.

*Primary Examiner*—Matthew C. Graham

(57) ABSTRACT

The invention relates to a home trainer designed to accommodate a bicycle, comprising a brakable drive roll incorporated in a frame, which can be mounted in a friction coupling with a driven wheel of the bicycle. The frame is provided with a sub-frame that is rotatable about a first pivoting point, the drive roll being mounted in the sub-frame. The frame is further provided with a handle rotatable about a second pivoting point, which is adjustable between an operational position wherein the handle pushes the sub-frame towards the wheel such that the drive roll and the wheel maintain the friction coupling, and a neutral position wherein the handle releases the sub-frame such that the drive roll and the wheel do not engage.

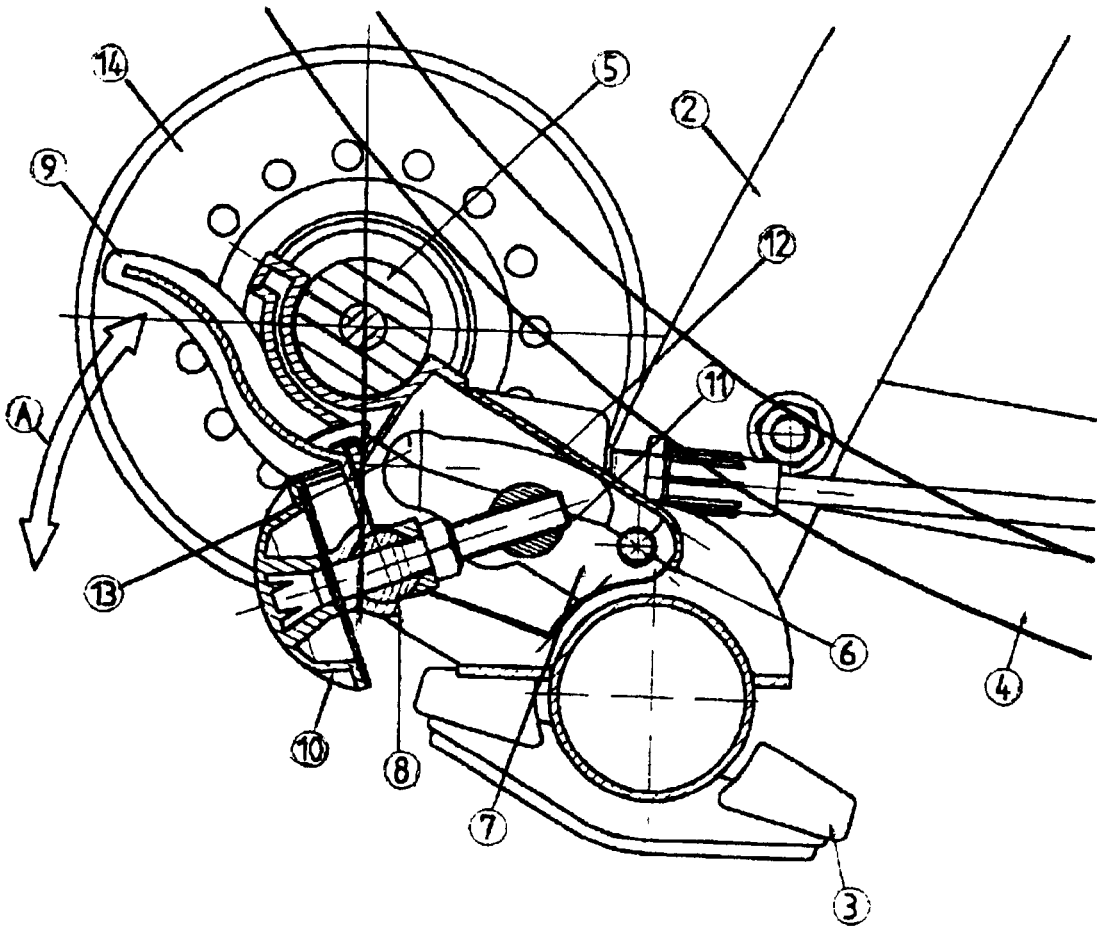

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1-7 is confirmed.

* * * * *